United States Patent [19]

Faurie

[11] Patent Number: 4,808,266

[45] Date of Patent: Feb. 28, 1989

[54] PROCEDURE AND DEVICE FOR THE ELIMINATION OF LIQUID FROM A LAYER FORMED ESPECIALLY THROUGH A PAPER PROCUDING PROCESS

[75] Inventor: André Faurie, Arcachon, France

[73] Assignee: La Cellulose Du Pin, Bordeaux, France

[21] Appl. No.: 51,218

[22] Filed: May 12, 1987

Related U.S. Application Data

[63] Continuation of Ser. No. 809,047, Dec. 16, 1985, abandoned.

[30] Foreign Application Priority Data

Dec. 17, 1984 [FR] France ..... 84 19245

[51] Int. Cl.[4] ..... D21F 11/00

[52] U.S. Cl. ..... 162/102; 162/157.6; 162/182; 162/203; 162/207; 162/208

[58] Field of Search ..... 162/9, 102, 157.1, 157.6, 162/164.45, 168.1, 182, 202, 203, 207, 208, 210, 297, 301, 308, 354, 376, 146

[56] References Cited

U.S. PATENT DOCUMENTS

| | | | |
|---|---|---|---|
| 1,881,404 | 10/1932 | Hadley | 162/208 |
| 2,753,766 | 7/1956 | Simpson | 162/297 |
| 2,929,448 | 3/1960 | Shoumatoff | 162/210 |
| 3,194,727 | 7/1965 | Adams et al. | 162/168.1 |
| 3,232,824 | 2/1966 | Bader | 162/157.1 |
| 3,301,746 | 1/1967 | Sanford et al. | 162/113 |
| 3,370,935 | 2/1968 | Adams et al. | 162/168.1 |
| 3,533,725 | 10/1970 | Bridgeford | 162/168.1 |
| 3,542,640 | 11/1970 | Friedberg et al. | 162/207 |
| 3,573,158 | 3/1971 | Pall et al. | 162/208 |
| 3,810,818 | 5/1974 | Arledter | 162/308 |
| 3,826,711 | 7/1974 | Schoggen et al. | 162/102 |

FOREIGN PATENT DOCUMENTS

| | | | |
|---|---|---|---|
| 787649 | 6/1968 | Canada | 162/101 |
| 246048 | 1/1926 | United Kingdom | 162/207 |

*Primary Examiner*—Peter Chin

*Attorney, Agent, or Firm*—Oblon, Fisher, Spivak, McClelland & Maier

[57] ABSTRACT

Continuous elimination of at least part of the liquid contained in a layer formed by depositing a liquid compound having a low solid matter content on a mobile, continuous, liquid-porous support, is effected by dripping, pressing and evaporation while the layer is maintained on the formation support without transfer. Evaporation means include means for passing a heated, gaseous flux through the layers.

6 Claims, 2 Drawing Sheets

PROCEDURE AND DEVICE FOR THE ELIMINATION OF LIQUID FROM A LAYER FORMED ESPECIALLY THROUGH A PAPER PROCUDING PROCESS

This application is a continuation of application Ser. No. 809,047 filed on Dec. 16, 1985 now abandoned.

BACKGROUND OF THE INVENTION

1. Field of the Invention

This invention pertains to the elimination of at least a portion of the liquid in a layer formed by the depositing, especially through the use of paper producing process, of a liquid compound with a low dry material (solid) content, on a mobile, continuous, liquid-porous support. The invention pertains specifically to the continuous production of a layer, by the depositing, on a mobile, continuous, porous support, of a liquid compound with a low dry material content, especially a liquid compound containing cellulose fibers, with the deposited layer having insufficient mechanical properties, during the liquid extraction phase, to allow the transfer from one support to another at a high speed.

2. Background of the Prior Art

The removal of the liquid portion of a layer with a low solid matter content is a problem which is encountered in various industries. This occurs in the removal of water from sediments, for example, sediments obtained in purification stations or those which one seeks to refine, especially as fertilizers.

This can also be useful in the paper industry, in which a liquid compound with a low paper fiber content is deposited on a mobile, porous cloth, to form a layer from which the liquid portion is subsequently extracted.

Although the invention pertains to various industries, the following description will be especially directed towards the application of the invention to the paper industry. In accordance with the invention, "paper" is defned as any cellulose fiberbased material, in the form of layers or sheets.

In the industrial production of paper, a liquid compound with a low paper fiber content, i.e., a low dry content, is poured on a continuously moving porous cloth. To pass from the liquid layer deposited on the formation cloth to the fibrous solid layer, the liquid is eliminated first by a gravitational dripping step, and/or by a suction through the porous cloth, by pressing between cloths and/or rollers; this operation can take place on the initial cloth, i.e., the layer formation cloth, or on one or several other subsequent cloths. After this, the fibrous layer is removed from the last cloth on which it was deposited so that it can be heated, for example, through contact with hot cylinders, so that more of its liquid content can be removed by evaporation. The elimination of liquid by dripping, then by pressing, then by heating and evaporation, is performed while the fibrous layer or bed is placed on different supports, the passage from the formation support to the subsequent support generally being done while the dry matter content is under 30%. Patent publication GB-A No. 1 389 992 describes such a liquid removal process with passage from one support to another.

In the specific case of low basis-weight papers, i.e., basis weights under about 30 g/m$^2$, the removal of water by evaporation is effected on a single drying cylinder and the transfer of the sheet of paper from the porous formation cloth to the drying cylinder is performed while the dry matter concentration is about 20% to 30% by weight. This implies that the production capacity of a line for low basis weights is limited by the diameter of the drying cylinder.

Other processes or devices for the removal of a portion of the water from a liquid compound with a low dry matter content, or those which are more concentrated, such as a slurry, are known. Thus, patent publication No. GB-A-2 047 396 describes a drying device for a slurry, by dripping, with suction, followed by evaporation of the water. Water extraction is not done in a continuous and effective manner in this case.

Accordingly, a need continues to exist for an effective method of removing liquid from a liquid compound layer with low solid content.

SUMMARY OF THE INVENTION

The invention proposes a new process for the continuous extraction of at least a portion of the liquid in a layer formed by continuous depositing on a mobile, porous support, of a liquid compound with a low dry matter (solid) content. According to the invention, the liquid is at least partially eliminated from the layer by gravitational dripping and/or, if need be, by suction, by pressing, and by evaporation, with all of these operations being effected while the layer is deposited on a same liquid-porous cloth, which is the formation support for the layer, thus, without any transfer from one support to another.

The process in accordance with the invention allows the continuous and rapid elimination of a quantity of liquid which can bring the layer to solid matter content level between about 30 and 100%, without said layer leaving the formation support, beginning with a liquid compound with a dry content under about 10% and preferably under 1%.

According to one advantageous characteristic of this procedure, the liquid is evaporated from the layer deposited on the formation support by the passage of a flow of gas through the layer. This can be a flux of air, nitrogen or another gas, depending especially on the nature of the liquid to be eliminated, as described in further detail below.

According to another advantageous characteristic of the invention, a second cloth or band is used, which sandwiches the layer to be processed between itself and the cloth utilized for the entire treatment. In one form of the process, the layer to be processed is sandwiched between the two cloths for only a part of the liquid extraction process. In one variation, the second cloth is utilized during essentially the entire liquid elimination treatment. The utilization (or not) of a second porous cloth in one or several areas, or in essentially the entire treatment, is dictated by the nature of the layer to be treated, i.e., especially its composition, its mechanical resistance in the forward direction, and also the liquid to be eliminated.

"Pressing", according to the invention, is defined as all operations tending to exert a pressure on the layer to extract the liquid from it.

Pressing can also vary according to the composition of the layer to be treated. It can vary in intensity and/or in the means implemented to accomplish it. It can vary according to its location, as well as according to the mechanical properties of the layer to be treated, at a precise location. It can also be of progressive intensity.

The process in accordance with the invention applies to the removal of a liquid, which can be water or any other diluting agent, allowing the formation of the layer on a porous formation support, for example, an alcohol, or a mixture of alcohols, chosen notably from the methyl, ethyl, or isopropyl alcohols.

Layers which can be treated according to the invention are any layers which are formed by the continuous depositing of a highly dilute liquid compound, on a continuously moving liquidporous support. These are, for example, layers containing sediments which must be dried, either to remove them without expending large amounts of energy, or to refine them. Included also are fiber-based layers, and, specifically, modified or unmodified cellulose fiber-based layers.

Thus, an advantageous application of the process consists of utilizing it for the production of beds or layers of fibers, especially for paper production, i.e. for the elimination of water or other diluting agents from liquid layers containing cellulose fibers, deposited on a porous formation cloth.

In addition, because the layer is maintained, according to the invention, on one support during the entire liquid removal treatment, the invention applies especially and advantageously to layers which are very fragile or which have very low mechanical resistance in the forward direction, and especially those which are not self-supporting.

Thus, the invention applies especially to the production of very low basis weight papers, which cannot be produced without the risk of tearing on a conventional paper production line, which requires a high-speed transfer of the fibrous layer from the formation cloth to cylinders for pressing. By using a continuous and single support for the entire treatment to remove the liquid contained in the layer, there is no risk of tearing this layer during treatment.

The invention thus applies advantageously to the production of paper with basis weights under about 30 g.

The invention also advantageously applies to the removal of liquid from a layer containing grafted cellulose fibers and especially to the production of dry, highly absorbant cellulose materials, i.e., those with a high capacity to retain water and physiological liquids. Thus, the invention applies in particular to the elimination of water from a fibrous layer of a material formed, for example, as the result of the following operations:

the cellulose contained in cellulose paste is activated, a polymerizable monomer is grafted at olefinic nonsaturation, having functional groups which can be hydrolyzed on the cellulose, the grafted cellulose paste is hydrolyzed with an alkali, the product is washed with water until it reaches a maximum state of expansion, the product is acidified to a pH such that, after the water is eliminated, it is at a minimum state of expansion, the product is transformed into its salt form, in the presence of a water-miscible liquid, and the liquid is eliminated after the formation of a layer conforming to the invention.

The water-miscible liquid is generally an alcohol such as methyl, ethyl or isopropyl alcohol, such that the liquid removal according to the invention consists of eliminating this alcohol.

The evaporation of the liquid in the layer supported by the porous cloth is advantageously improved through the use of a flow of gas passing through the layer. This gas flux can consist of a flow of hot air. In one variation, it can be a flow of nitrogen.

The evaporation treatment post is advantageously placed in a closed chamber in cases in which the liquid to be removed from the layer is an organic liquid, especially to avoid harmful fumes. Moreover, all of the liquid elimination operations can be conducted in a nitrogen atmosphere, if needed.

The invention also applies to the removal of liquid contained in superimposed layers by simultaneous or successive jets.

The invention also pertains to a device to eliminate the liquid part of a layer formed continuously by depositing a highly dilute compound on a moving support.

The device in accordance with the invention comprises a moving support cloth, which is continuous, porous to the liquid to be eliminated, extending over the entire area of the device, means to deposit the liquid compound on the porous cloth, with these means being placed in the upsteam part of the device, means to eliminate a part of the liquid by pressing, means to eliminate another part of the liquid by evaporation, with all of these means being placed above and/or below the porous cloth supporting the poured layer, with the porous cloth having characteristics such that it permits drippng, pressing, heating, etc...

In addition, to accentuate the pressing, the device can include a wide variety of pressing means, which are known especially in the paper producing industry, for example, one or several pair of cylinders between which the layer to be treated is pressed, one or several toggles, etc...

One embodiment of the device also comprises an upper band or cloth which, combined with the lower depositing cloth, sandwiches the layer to be treated in at least one of the liquid removal areas. When the device is utilized to treat particularly fragile layers, this second band maintains the layer to be treated in a sandwich, preferably from the time it is formed or immediately thereafter, until the end of the treatment.

When the device is utilized to remove an organic liquid, such as alcohol, the complex can be placed in an enclosed chamber under an atmosphere which is inert with respect to the liquid to be removed from the layer.

The means to remove the liquid by evaporation are advantageously means which create a flow of gas passing through the layer. These means can comprise suction vessels and their associated blowing vessels, which are placed opposite the suction vessels on both sides of the porous support cloth.

Other characteristics and advantages of the invention will emerge in the examples for the embodiment of the device according to the invention.

DETAILED DESCRIPTION OF THE INVENTION

Figure 1:
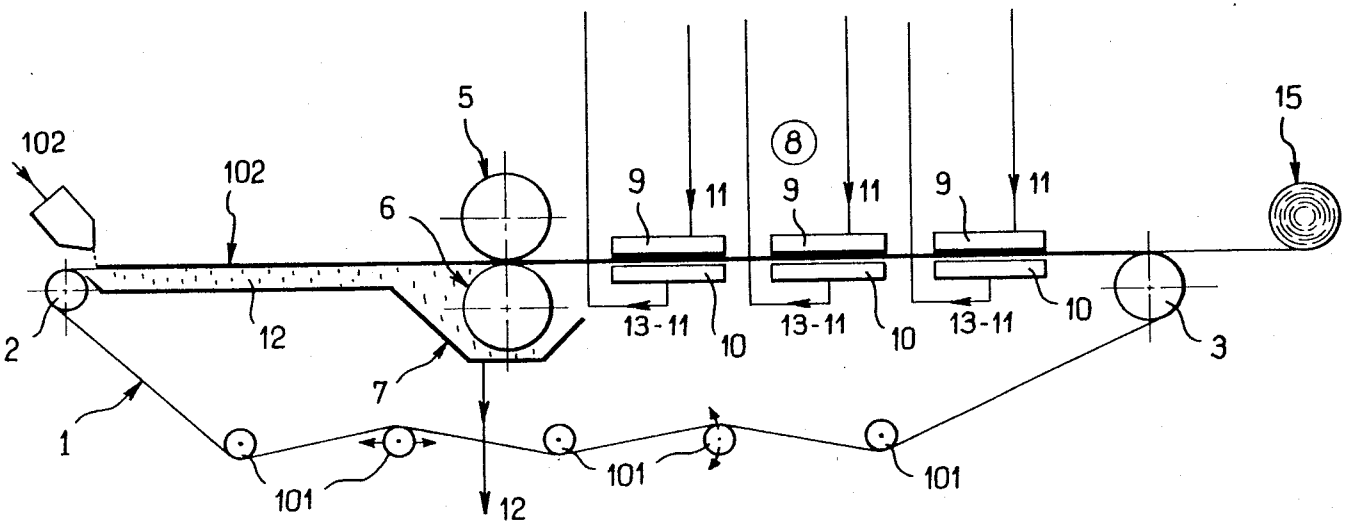
FIG. 1 shows a device utilized for the production of a very low basis weight paper.

The device shown in FIG. 1 comprises a continuous support cloth 1, which is kept stretched between the rollers 101 and especially its upper part, between an upstream roller 2 and a downstream roller 3. In the upstream part of the device, a headbox 4 extends transversally above the cloth 1. Located further downstream, the device is endowed with a press, which is comprised of two rollers 5 and 6, placed on both sides of the transporting cloth. A vat 7 is placed under the upper part of the transporting cloth, to collect the liquid removed by and pressing.

Downstream from the press, the device has means 8 to remove water by evaporation. Here, these means are comprised of a succession of gaseous flux blowing vessels 9 and suction vessels 10, arranged above and below the transporting cloth. Each blowing vessel faces a suction vessel on the opposite side of the cloth. These vessels are fed with hot air 11.

The operation of the device is described in relation to the production of paper with a basis weight of 10 g/m2. Aqueous paper compound 102, with a dry matter concentration of about 0.2% is brought to the headbox, from which it is poured to form a layer of liquid with a homogeneous thickness, on the support cloth 1.

While it is transported, a part of the water 12 is eliminatetd by dripping, passing through the porous cloth 1 by force of gravity. More of the water is removed by pressing, in which it is pressed between the two rollers 5 and 6. The water which passes through the porous cloth 1 is collected in the vat 7. In passage between the blowing vessels 9 and suction vessels 10, an additional quantity of water is removed in the form of steam 13 by the hot air flow. At the end of the device, the sheet of paper 14 is removed from the cloth, to be rolled on a reel 15 and stored.

Figure 2:
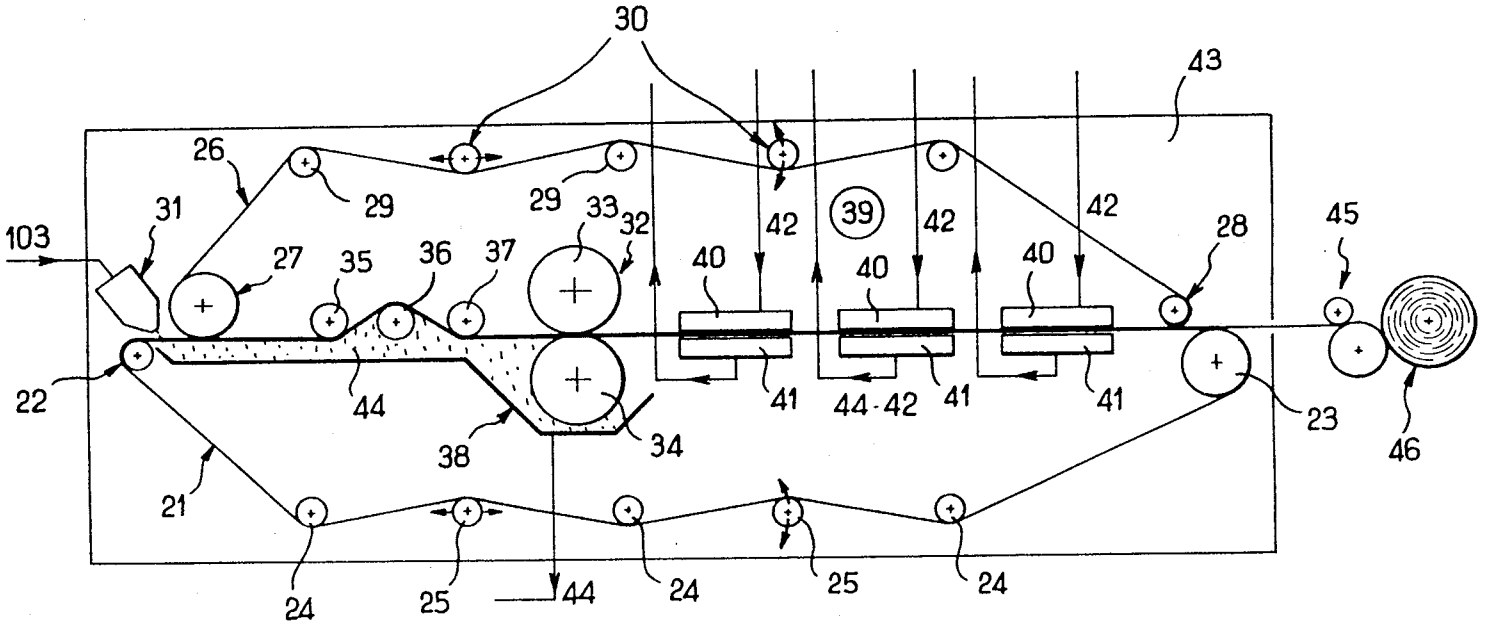
FIG. 2 shows a device utilized for the production of a highly absorbant layer made of grafted cellulose fibers.

The device shown in FIG. 2 is utilized in the production of a highly absorbant grafted cellulose fiber-based layer. This device comprises a continuous support cloth 21, whose upper part is kept stretched between rollers, notably an upstream roller 22 and a downstream roller 23. Rollers 24, 25, some of which 25 have adjustable positions, act on the lower part of the cloth and allow it to be properly stretched. A second porous cloth 26 is placed above the first cloth, parallel to it, streteched between rollers, notably an upstream roller 27 and a downstream roller 28. Rollers 29, 30, some of which 30 have adjustable positions, stretch the cloth 21 appropriately. A headbox 31 extends transversally above the lower support cloth, upstream from the roller 27. The device is also endowed with a press 32, comprised of two rollers 33 and 34, placed on both sides of the two cloths. Between the roller 27 and the press 32, three rollers 35, 36, 37, constitute a toggle for the two cloths. There is a vat 38 located under the upper part of the lower transporting cloth 26, to collect the liquid removed by dripping and pressing. Downstream from the press 32, the device is equipped with means 39 to eliminate liquid by evaporation. These means are gaseous flux blowing vessels 40 and suction vessels 41, placed above and below the two cloths. Each blowing vessel faces a suction vessel on the opposite side of the two cloths. These vessels are fed with nitrogen 42.

The whole complex is described in relation with the production of a sheet of highly absorbant cellulose material.

A liquid compound 103 containing modified cellulose fibers on which a polymer is chemically bonded in the form of an alkaline metal salt coming from a monomer which can be polymerized at olefinic non-saturation, in a mixture of ethyl alcohol and ammonia solution, having a dry matter concentration of about 0.3%, is brought to the headbox, from which it is made into sheets on the transporting cloth 21. The liquid layer is carried by said cloth and it is sandwiched between this cloth 21 and the upper cloth 26. A part of the liquid 44 is eliminated by dripping and pressing through the lower cloth 21 and is collected in the vat 38, under the cloth 21 to be subsequently recycled. The pressing is accentuated at the passage of the toggle. The layer, still sandwiched between the two cloths, next passes between the two press rolls, which further supplements the pressing. The layer next passes between the blowing and suction vessels. At this time a flow of nitrogen 42 passing through the upper cloth eliminates an additional part of the liquid through evaporation by contact with the flux 42. The gaseous nitrogen current laden with the gaseous alcohol—ammonia solution mixture 45 passes through the lower cloth, passes into the suction vessels and is sent to an additional steam collection device (not shown). When it issues from the vessel zone, the layer, which is still between the two clothes, is dry. After the upper cloth is removed from the fibrous layer, it separates from the lower cloth, and the layer is rolled on a reel 46 through the use of a rolling device 45.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for the continuous removal according to a paper production process of at least a portion of the liquid in a layer formed by pouring from a headbox, on a moving, continuous, liquid-porous formation support, of a liquid suspension comprising highly absorbent cellulose fibers having a polymerized olefinic monomer grafted thereon and having hydrolyzable functional groups, and said liquid to be removed comprising an alcohol selected from the group consisting of ethyl alcohol, methyl alcohol, isopropyl alcohol and mixtures thereof, said suspension having a solid matter content of less than about 10% by weight, said liquid being removed by gravitational dripping and/or by suction, by pressing, and evaporation, to form a paper layer of said grafted cellulose fibers, the improvement comprising that all of these liquid removal operations bring the layer to a solid matter concentration greater than about 30% and are performed on a single porous substantially horizontal formation support, and wherein the evaporation of a part of the liquid in the layer deposited on said formation support is achieved by passing a nitrogen flux through the layer and further wherein the layer is sandwiched between the formation support and a continuous porous upper support during the entire liquid removal treatment.

2. Process according to claim 1, wherein all of the operations are performed in a closed chamber.

3. Process according to claim 2, wherein the chamber is provided with a nitrogen atmosphere.

4. The process according to claim 3 wherein the dry matter concentration of the liquid in the headbox is less than 1%.

5. In a process for the continuous removal according to a paper production process of at least a portion of the water in a layer formed by pouring from a headbox, on a moving, continuous, liquid-porous formation support, of a liquid composition composed of an aqueous suspension of cellulose fibers having a solid matter content of less than about 10% by weight, said water being removed by gravitational dripping and/or by suction, by pressing, and by evaporation, to form a cellulose-fiber based paper layer with a basis weight under 30 g/m$^2$, the improvement comprising that all of these water removal operations bring the layer to a solid matter concentration greater than about 30% and are performed on a single porous substantially horizontal support, which is the porous formation support for the layer, and wherein the evaporation of a part of the water in the layer deposited on said formation support is achieved by passing hot air through the layer and further wherein the layer is sandwiched between the formation support and a continuous porous upper support during the entire water removal treatment.

6. The process according to claim 1 wherein the dry matter concentration of the liquid in the headbox is less than 1%.

* * * * *